US005096194A

United States Patent [19]

Yong et al.

[11] Patent Number: 5,096,194

[45] Date of Patent: Mar. 17, 1992

[54] DEVICE FOR PREVENTING TENNIS ELBOW

[75] Inventors: Katherine O. B. Yong; Wong C. Kim, both of Selanger Darul Ehsan, Malaysia

[73] Assignee: Rubbermade Accessories SDN. BHD., Subang Jaya, Malaysia

[21] Appl. No.: 648,832

[22] Filed: Jan. 31, 1991

[51] Int. Cl.[5] ..... A63B 51/10

[52] U.S. Cl. ..... 273/73 D; 273/73 R

[58] Field of Search ..... 273/73 D, 73 R, 73 C, 273/73 E, 73 G

[56] References Cited

U.S. PATENT DOCUMENTS

| | | | |
|---|---|---|---|
| 2,732,209 | 1/1956 | Forbes | 273/73 R |
| 3,874,666 | 4/1975 | Ross | 273/73 R |
| 4,575,083 | 3/1986 | Adam | 273/73 D |
| 4,732,383 | 3/1988 | Ferrari et al. | 273/73 D |
| 4,761,007 | 8/1988 | Boschian | 273/73 D |
| 4,776,590 | 10/1988 | Krent et al. | 273/73 D |
| 4,911,445 | 3/1990 | Ferrari et al. | 273/73 D |
| 4,927,143 | 5/1990 | Hillock | 273/73 D |
| 4,962,928 | 10/1990 | Camara et al. | 273/73 D |

FOREIGN PATENT DOCUMENTS

| | | | |
|---|---|---|---|
| 8901809 | 3/1989 | Sweden | 273/73 D |

*Primary Examiner*—Edward M. Coven
*Assistant Examiner*—Steven B. Wong
*Attorney, Agent, or Firm*—Salter, Michaelson & Benson

[57] ABSTRACT

A device for relieving tennis elbow and that is mountable on the strings of a sports racquet, the device being defined by an elongated flexible, rubber-like strap having dampening characteristics and that is formed with a plurality of transversely extending external ribs thereon in spaced apart longitudinal relation, the flexible strap being interwoven between adjacent longitudinally extending strings of the racquet, wherein the ribs as formed on the flexible strap define stops for locating the flexible strap in a positive position on the longitudinally extending strings for preventing the lateral shifting of the flexible strap thereon.

8 Claims, 2 Drawing Sheets

DEVICE FOR PREVENTING TENNIS ELBOW

BACKGROUND OF THE INVENTION

The present invention relates to a device for relieving stress on the arm of a user of a sports racquet, wherein the device is mountable on the racquet and comprises an elongated flexible rubber-like strap having dampening characteristics.

Sports racquets of the type to which the subject invention is applied, that is, those racquets used for playing tennis, racquetball, squash, badminton, and the like, have a particular construction when made of materials other than wood that tend to transfer vibrational stresses created upon an impact of a ball on the racquet strings to the arm of the user. Constant use of such a racquet quite frequently results in what is commonly known as "tennis elbow", and usually results from vibrations that occur upon frequent impact of a ball against the racquet strings. Tennis elbow can essentially incapacitate a user in play since considerable discomfort will occur during the use of the racquet in the play of a game.

Some efforts have been made to diminish the vibration and shock that results from impact of a ball on the strings of a racquet, particularly when a non-wooden racquet is utilized, and in some of these prior known devices, attempts have been made to reduce shock and vibration resulting from impact of a ball on the racquet strings by connecting certain of the strings of the racquet through a plug type of device. Such devices are illustrated, for example, in the U.S. Pat. Nos. 4,761,007 and 4,909,509 to BOSCHIAN, and the U.S. Pat. No. 4,927,143 to HILLOCK. Although the devices as described in the aforementioned U.S. patents are intended to provide some form of a dampening effect, the devices have not been found to be very effective in dampening the vibrations resulting from impact of a ball on the strings of a racquet, and as a result have not been readily accepted for use.

Some efforts have also been made to provide strip-like dampening devices for use in stringed racquets for reducing shock and vibration upon use of the racquet in play, and examples of these types of devices are illustrated in the U.S. Pat. Nos. 4,732,383 and 4,911,445 to FERRARI et al, and ADAM U.S. Pat. No. 4,575,083. As will be noted, the devices as illustrated in these latter patents are mounted on the longitudinally extending strings of a racquet by some form of end connections, but the end connections do not provide for sufficient securement of the device to the racquet strings to adequately dampen vibration and shock upon use of the sports racquet, and as a result such constructions have not found sufficient favor in the trade.

As will be set forth hereinafter, the subject invention provides an improvement over the prior known devices as illustrated in the aforesaid patents, and effectively dampens vibration and shock that occur upon the impact of a ball against the strings of a racquet in the use thereof and is further prevented from shifting on the strings during use of the racquet.

SUMMARY OF THE INVENTION

The present invention discloses a device for relieving stress on the elbow of the user of a sports racquet, wherein the device is mountable on the racquet which has a racquet head to which a handle portion is joined. The racquet head is provided with laterally and longitudinally extending strings that are secured therein, and the invention provides for the use of an elongated flexible, rubber-like strap having dampening characteristics and that has a plurality of transversely extending spaced apart external ribs formed thereon. The flexible strap of the subject invention is interwoven between adjacent longitudinally extending strings of the racquet head, wherein the ribs as formed on the strap define stops for locating the strap in a positive position on the longitudinally extending strings and thereby prevent the lateral shifting of the strap thereon. The flexible strap as thus located on the strings of the racquet head effectively absorb shock and vibration of said strings when a ball is actively impacted therewith.

Accordingly, it is an object of the present invention to provide an elongated flexible rubber-like strap for absorbing and dampening shock and vibration in the use of a sports racquet when in play and to provide for means on the exterior surfaces of the device by which the device is positively held in place on longitudinally extending strings of the racquet.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
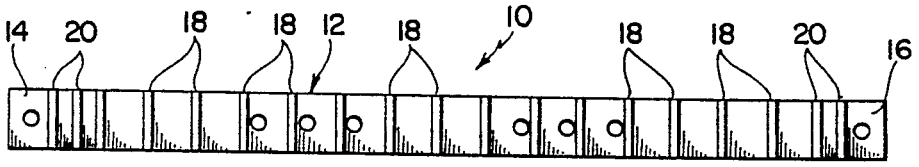
FIG. 1 is a front elevational view of the elongated flexible vibration dampening strap of the subject invention.
Figure 2:
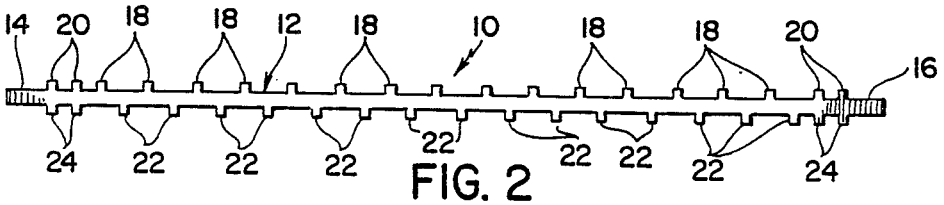
FIG. 2 is a top plan view thereof showing the external ribs as formed on the surfaces of the strap.

Referring now to the drawings and particularly to FIGS. 1 and 2, the vibration dampening device as embodied in the subject invention is illustrated and is generally indicated at 10. The vibration dampening device 10 is defined as an elongated flexible narrow strap that may be formed of an elastic material such as a natural rubber or a synthetic rubber such as chlorinated rubber or polyvinyl chloride or other similar and well known plastic materials. It is also contemplated that the elongated flexible strap 10 be formed of other rubber-like materials such as high density cellular urethane (PORON), or a polymer or a blend of polymers that provides vibration dampening characteristics. Examples of such polymers are butyl rubber, acrylonitrile-butadiene elastomer, epoxidised natural rubber, polynobornene, and any blend of the stated materials. The blends of the above stated polymers may also be combined with polyvinyl chloride (PVC), natural rubber, EPDM, or styrene butadiene rubber. The materials may be combined by any well known and accepted procedure and compression molded to form the strap 10.

Referring again to FIGS. 1 and 2, it is seen that the flexible narrow strap 10 is molded in an elongated body portion generally indicated at 12 that has end portions 14 and 16 integrally joined thereto. Formed on one of the surfaces of the body portion 12 as seen in FIG. 1 are a plurality of transversely extending ribs 18 that are located in spaced apart relation as they extend along the longitudinal dimension of the body portion 12. The spacing of the ribs 18 on the surface of the body portion 12 as shown in FIG. 1 is substantially constant throughout the length of the body portion 12, except at the ends thereof where transversely extending ribs 20 are disposed in closer relationship than those extending along the major portion of the length of the body portion, the purpose of which will be described hereinafter.

As illustrated in FIG. 2, a second set of transversely extending ribs 22 are formed on the surface of the body portion 12 opposite to the surface on which the ribs 18 are formed and are disposed in staggered relation with respect to the ribs 18. Ribs 24 are also located adjacent to the end portions 14 and 16 and are more closely spaced together than the ribs 22. As will be described, the ribs 18, 20, 22, and 24 are disposed such that they provide stops for locating the strap in a positive manner on the longitudinally extending strings of a sports racquet.

Figure 3:
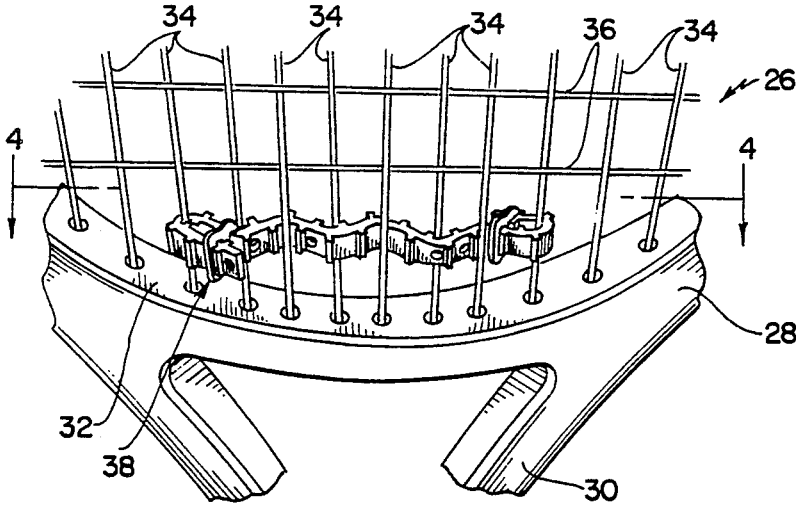
FIG. 3 is a perspective view showing the strap as mounted on eight of the centermost of the longitudinally extending strings of a racquet and further illustrating the use of end clips for securing the strap in place.

Referring now to FIG. 3, a portion of a sports racquet is illustrated and is generally indicated at 26, FIG. 3 further showing the manner in which the strap 10 is mounted on the racquet 26. The racquet 26 may be formed of any known material and may be molded of a material such as metal, graphite, fiberglass, or other similar materials and may be tubular in construction. The racquet 26 comprises a head, a portion of a frame of which is indicated at 28, and a handle, a portion of which is indicated at 30, the handle 30 and the head 28 being molded as a unitary construction. Suitable string holes are formed in an interior surface 32 of the head frame 28 of the racquet and receive longitudinally extending strings 34 therein in the conventional manner. Although not shown, additional strings holes are also formed in the frame 28 for receiving laterally extending strings 36 therein. The manner in which the strings 34 and 36 are joined to the frame 28 of the racquet head is conventional and forms no part of the subject invention.

Figure 4:
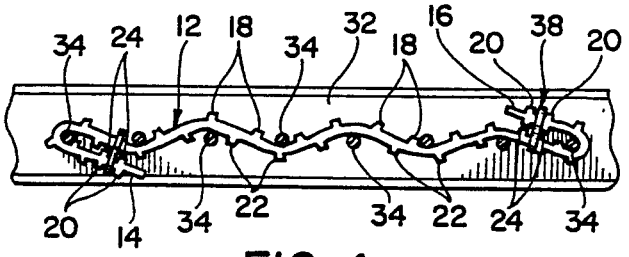
FIG. 4 is a sectional view taken along line 4—4 in FIG. 3.

Referring now to FIGS. 3 and 4, the flexible strap 10 of the subject invention is illustrated as mounted on the central eight longitudinally extending strings of the racquet head 26 at the lowermost end thereof. In this connection, the strap 10 is interwoven through the longitudinally extending strings 34 adjacent to the frame 28, the end portions 14 and 16 of the strap 10 being bent around the endmost of the longitudinally extending strings 34 on which the strap 10 is mounted. It is seen that the ribs 18 and 22 effectively define stops for the strings 34 and provide for positive location of the strap 10 on the longitudinally extending strings 34 with which the strap is interwoven.

Figure 7:
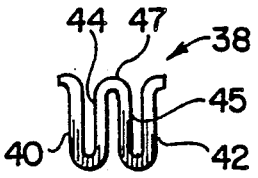
FIG. 7 is an elevational view of a clip that secures the ends of the elongated dampening strap to the body portion thereof as illustrated in FIGS. 3–6.

In order to secure the strap 10 to the strings 34, a clip generally indicated at 38 in FIG. 7 is provided. The clip 38 includes outer fingers 40 and 42 that are integrally joined to inner fingers 44 and 45, respectively, fingers 44 and 45 being joined by a bight portion 47. The fingers 40, 42, and 44, 45, cooperate to provide for attachment of the clip 38 to the strap 10 for securing the strap in place on the strings 34 as will be described.

Referring once more to FIGS. 3 and 4, the strap 10 is shown as mounted in place on the central most eight strings of the longitudinally extending strings 34. In this connection, the strap 10 is bent around the endmost of the longitudinally extending centrally disposed eight strings, the end portions 14 and 16 overlapping adjacent areas of the body portion 12. The clip 38 secures the strap in place on the strings 34 by sliding the finger 40 and the adjacent inner finger 44 between the ribs 20 while the finger 42 and the inner finger 45 slide over the corresponding portion of the body portion 12 between the adjacent ribs 24. Similarly, the end portion 16 of the strap lo extends around the opposite endmost longitudinally extending string 34 and is disposed in adjacent relation to the body portion 12, the fingers 40 and 42 of a second clip 38 extending between the ribs 20 and 24 while the fingers 42 and 45 of the second cup 38 slide over the end portion 16 between the adjacent ribs 20 and 24 for locking the strap end portion 16 in place. It is understood that the intermediate ribs 18 and 22 of the strap 10 cooperate to prevent the lateral shifting of the strap as mounted on the strings 34, the ribs providing stops for preventing the strap 10 from moving laterally with respect to the strings 34.

In use of the racquet 26, it is seen that the vibration frequencies that are generated upon impact of a ball against the strings 34 and 36 are absorbed by the flexible strap 10 which essentially dissipates the impact energy. The absorption of the vibrations as generated by the impact of the ball against the strings 34 and 36, thus prevents the vibrations from extending through the handle 38 and into the arm of the user of the racquet. Thus, the device relieves stress on the elbow of the user of the racquet as a ball periodically impacts against the racquet strings.

Figure 5:
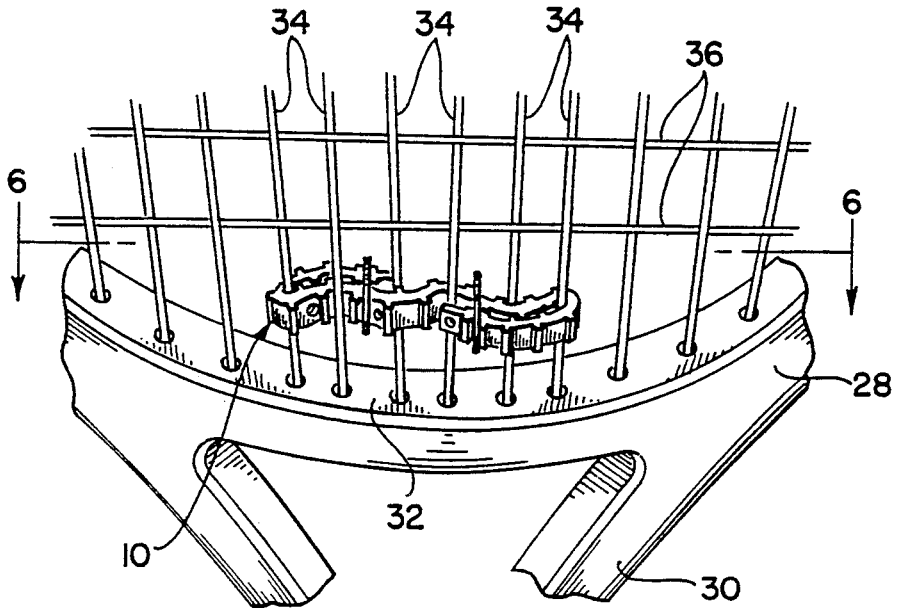
FIG. 5 is a perspective view showing the vibration dampening strap of the subject invention as mounted on six of the centermost of the longitudinally extending strings of the racquet and as held in place by fastening clips.
Figure 6:
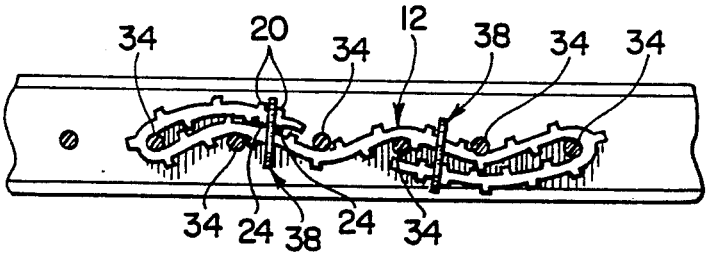
FIG. 6 is a sectional view taken along line 6—6 in FIG. 5.

Referring now to FIGS. 5 and 6, a modified form of the invention is illustrated, wherein the flexible strap 10 is mounted on the six centermost of the longitudinally extending strings 34 of a racquet. In this connection, the strap 10, because of its length when folded around the endmost of the longitudinally extending strings, overlaps a greater portion of the body portion 12 than that illustrated in FIGS. 3 and 4. In this event, the strap 10 is also held in place by clips 38 in the manner illustrated in FIGS. 3 and 4, the fingers 40, 44 of the clips 38 being engaged with the end portions 14 and 16 of the strip body between the ribs 20 and 24 and the fingers 42 and 45 of the clip 38 engaging the corresponding portions of the overlapped body portion 12.

The arrangement of the strap 10 as it is mounted on the six centermost of the longitudinally extending strings 34 as shown in FIGS. 5 and 6 tends to concentrate absorption of the vibration resulting from the impact of the ball against the strings and may better serve the purpose of preventing vibration frequencies from generating into the handle portion 30 of the racquet.

Figure 8:
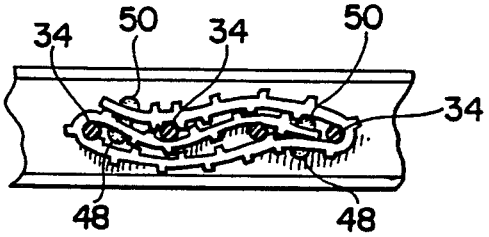
FIG. 8 is a sectional view similar to FIG. 5 showing the strap as mounted in place on four of the centermost strings of a racquet and further illustrating the ends of the strap being held in place by bolt fasteners.
Figure 9:
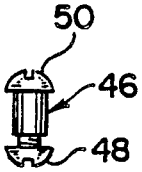
FIG. 9 is an elevational view of a bolt fastener as utilized in the fastening of the end portions of the strap to the body portion thereof as shown in FIG. 8.

It is also contemplated to concentrate the location of the strap 10 in a more defined area, and for this purpose, the strap 10 may be secured around the centermost four of the strings 34 as illustrated in FIG. 8. In this connection, a fastener such as a twin headed bolt fastener 46 is provided and includes a male portion 48 that is inserted into a female portion 50, the male and female portions of the fastener 46 being located at the appropriate places adjacent to the ends 14 and 16 of the strap. The male portion 48 extends through appropriate holes as formed in the body portion 12 of the strap 10 and is received in the female portion 50 of the bolt fastener 46 to secure the strap in place as shown in FIG. 8.

In all forms of the invention as illustrated and described herein, the strap 10 defines a dampening device that absorbs energy and the shock resulting from impact of a ball against the strings 34 and 36 and prevents the frequencies of vibration from extending through the handle 30 of the racquet to the arm of the user. Thus, the vibration dampening device 10 relieves stress on the arm of the user and effectively prevents tennis elbow from occurring.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for relieving stress on the arm of a user of a sports racquet wherein the racquet includes a head to which a handle portion is joined, said racquet head having laterally and longitudinally extending strings secured therein, comprising an elongated flexible, rubber-like strap having dampening characteristics, said flexible strap including a body portion having opposed surfaces, each of which has a plurality of transversely extending ribs formed thereon in spaced apart longitudinally extending relation, each of the ribs on one surface for a major portion of the length thereof being offset with respect to opposed ribs as formed on a major portion of the length of said opposite surface of said body portion, said flexible strap being interwoven between adjacent longitudinally extending strings of said racquet head, wherein said opposed ribs as formed on both surfaces of said flexible strap define stops for locating said flexible strap in a positive position on said longitudinally extending strings and for preventing the lateral shifting of said flexible strap thereon, said flexible strap being located on said racquet head for absorbing shock and vibration of said strings when a ball is actively impacted therewith.

2. A device as claimed in claim 1, said flexible strap being located on said longitudinally extending strings adjacent to the handle of said racquet.

3. A device as claimed in claim 1, end portions being integrally joined to the body portion of said flexible strap, and means for securing the end portions of said flexible strap in overlapping relation with respect to said body portion thereof and in secure engagement with the longitudinally extending strings with which said flexible strap is interwoven.

4. A device as claimed in claim 3, said flexible strap being interwoven with eight of said longitudinally extending strings.

5. A device as claimed in claim 3, said flexible strap being interwoven with eight of said longitudinally extending strings.

6. A device as claimed in claim 3, said flexible strap being interwoven with six of said longitudinally extending strings.

7. A device for relieving stress on the arm of a user of a sports racquet wherein the racquet includes a head to which a handle portion is joined, said racquet head having laterally and longitudinally extending strings secured therein, comprising an elongated flexible, rubber-like strap having dampening characteristics, said flexible strap having a plurality of transversely extending external ribs formed thereon in spaced apart longitudinal relation, said flexible strap being interwoven between adjacent longitudinally extending strings of said racquet head, wherein said ribs as formed on said flexible strap define stops for locating said flexible strap in a positive position on said longitudinally extending strings and for preventing the lateral shifting of said flexible strap thereon, said flexible strap being located on said racquet head for absorbing shock and vibration of said strings when a ball is actively impacted therewith, said flexible strap including a body portion having opposed surfaces, each of which has said transversely extending ribs formed thereon, end portions being integrally joined to the body portion of said flexible strap, and means for securing the end portions of said flexible strap in overlapping relation with respect to said body portion thereof and in secure engagement with the longitudinally extending strings with which said flexible strap is interwoven, said securing means including clips that are formed with spaced fingers between which the overlapping end portions and body portion of the flexible strap are received to lock the flexible strap onto said longitudinally extending strings.

8. A device for relieving stress on the arm of a user of a sports racquet wherein the racquet includes a head to which a handle portion is joined, said racquet head having laterally and longitudinally extending strings secured therein, comprising an elongated flexible, rubber-like strap having dampening characteristics, said flexible strap having a plurality of transversely extending external ribs formed thereon in spaced apart longitudinal relation, said flexible strap being interwoven between adjacent longitudinally extending strings of said racquet head, wherein said opposed ribs as formed on said flexible strap define stops for locating said flexible strap in a positive position on said longitudinally extending strings and for preventing the lateral shifting of said flexible strap thereon, said flexible strap being located on said racquet head for absorbing shock and vibration of said strings when a ball is actively impacted therewith, said flexible strap including a body portion having opposed surfaces, each of which has said transversely extending ribs formed thereon, end portions being integrally joined to the body portion of said flexible strap, and means for securing the end portions of said flexible strap in overlapping relation with respect to said body portion thereof and in secure engagement with the longitudinally extending strings with which said flexible strap is interwoven, said securing means including fasteners that extend through said flexible strap end portions and body portion for securing the flexible strap to said longitudinally extending strings.

* * * * *